US006312245B1

(12) United States Patent
Beeck et al.

(10) Patent No.: US 6,312,245 B1
(45) Date of Patent: Nov. 6, 2001

(54) REHEATER DOOR OF A SPINNING DEVICE

(75) Inventors: Heinz-Dieter Beeck, Frankfurt am Main; Guenter Koschinek, Dietzenbach; Werner Mrose, Maintal; Rolf Wagner, Frankfurt am Main, all of (DE)

(73) Assignee: Lurgi Zimmer Aktiengesellschaft, Frankfurt am Main (DE)

( * ) Notice: Subject to any disclaimer, the term of this patent is extended or adjusted under 35 U.S.C. 154(b) by 0 days.

(21) Appl. No.: 09/274,942

(22) Filed: Mar. 23, 1999

(30) Foreign Application Priority Data

Aug. 13, 1998 (DE) ..... 198 36 682

(51) Int. Cl.[7] ..... B29C 47/88
(52) U.S. Cl. ..... 425/73; 425/192 S; 425/378.2
(58) Field of Search ..... 425/72.2, 73, 192 S, 425/190, 377, 378.2, 464

(56) References Cited

U.S. PATENT DOCUMENTS 2,982,994 * 5/1961 Fernstrom ..... 425/72.2
3,016,573 * 1/1962 Blue ..... 425/73
3,902,834 * 9/1975 Hagenburg ..... 425/73
4,681,522 * 7/1987 Lenk ..... 425/72.2
4,973,236 * 11/1990 Hasegawa et al. ..... 425/72.2
5,088,913 * 2/1992 Chambers ..... 425/72.2
5,173,310 * 12/1992 Katou et al. ..... 425/72.2
5,219,585 * 6/1993 Shealy et al. ..... 425/72.2
5,645,862 * 7/1997 Sable et al. ..... 425/73

OTHER PUBLICATIONS

Franz Fourné. *Synthetische Fasern*. Carl–Hanser–Verlag: Munich, 1995, pp. 182–183, 363.

* cited by examiner

*Primary Examiner*—Nam Nguyen
*Assistant Examiner*—Joseph Leyson
(74) *Attorney, Agent, or Firm*—McDonnell Boehnen Hulbert & Berghoff

(57) ABSTRACT

The invention provides a reheater door of a spinning device, which door is constructed so as to facilitate relatively easy access to the spinning nozzle plate as well as enable suction removal of vaporizable compounds and prevention of substantial cooling even when the door is open.

8 Claims, 4 Drawing Sheets

1
14
13

4
3
2
1g
d
S
7
I
4'
3'
2'
12
II
1

REHEATER DOOR OF A SPINNING DEVICE

BACKGROUND OF THE INVENTION

1. Field of the Invention

The invention relates to a reheater door of a melt-spinning device such as those used for the production of fibers such as polyester.

2. Summary of the Related Art

Reheaters of spinning devices are known. Reheating zones have been described in Franz Fourné, Synthetische Fasern [Synthetic Fibers], Carl-Hanser-Verlag Munich, 1995, pages 182, 183 and 363. The process described therein concerns the delayed cooling of the filaments under the nozzle in a reheater, thereby preventing excessively rapid cooling of the filament surface and the resulting high pre-orientation. The result is a decreased drawing-off speed and a decreased pre-orientation, and thus an improved stretchability and higher final tenacity of the filaments. The reheaters generally have a body made of fine steel, which can be heated, for example, with electrical heating bands. The heating zones formed by the reheaters usually have a length of 100–300 mm. A disadvantage of the known reheaters, however, is that the spinning nozzle plates are relatively difficult to access because the heatable bodies are positioned immediately below the plates, making mounting and replacement of spinning nozzle plates difficult. An additional disadvantage is that it is not possible to remove undesirable vaporizable compounds from the opened reheater by suction.

SUMMARY OF THE INVENTION

The present invention provides a reheater door of a spinning device that provides for relatively easy access to the associated spinning nozzle plates. Preferably, this door is constructed such that it is possible to remove vaporizable compounds from the reheater by suction, even if the door is open. In addition, it should be possible, in a relatively simple manner, to maintain the door largely at the operating temperature even when open.

DETAILED DESCRIPTION OF THE INVENTION

Figure 1:
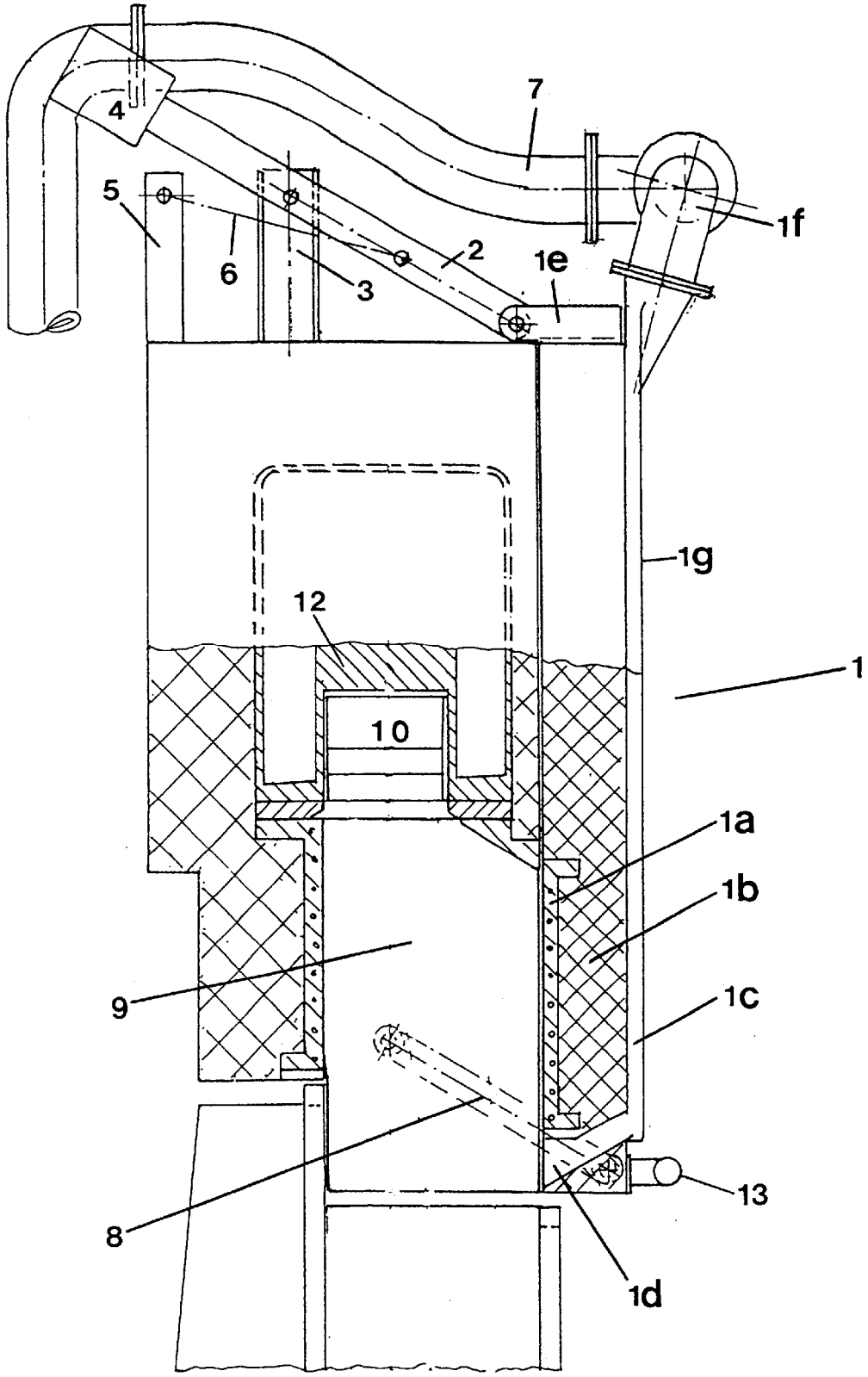
FIG. 1 shows the closed door of a reheater, the reheater, and the spinning head in cross section.

The present invention comprises a reheater door of a spinning device, which door consists of a heatable metal body, insulation positioned externally and adjacently to the metal body, and a vertically positioned suction duct externally adjacent to the insulation, and which suction duct opens at its bottom section into an essentially horizontally positioned suction duct, wherein the door is opened by sliding it vertically upwards. Said sliding can be done by mechanical, pneumatical, electrical or hydraulic means. Preferably the top part of the door has a connection with at least one lever that is a part of a lever system consisting of at least one lever, a support, and a counter weight. The term spinning device is defined as a melt-spinning device. The metal body can be made of steel or aluminum alloys, for example. The insulation is a thermal insulation such as, for example, mineral wool. The expression "essentially horizontal arrangement" includes a perfectly horizontal arrangement as well as slanted arrangements whose angle of slope is less than 45°. It was discovered surprisingly that when the reheater door is open the horizontally positioned suction duct can be positioned directly and immediately below the spinning nozzle plate so that removal of undesirable vaporizable compounds by suction is possible. When the door is open, the heatable metal body is positioned adjacently and externally to the spinning device, thus preventing cooling of the heatable metal body when the door is open so that the door can be maintained at the operating temperature in a relatively simple manner even when open. It is thus ensured that the door, both when closed and open, is applied firmly against the spinning device, with an even distribution of forces applied over the entire surface area. Since the vertically positioned suction duct and the essentially horizontally positioned suction duct represent components of the door, it is possible to remove by suction the undesirable vaporizable components when the door is either open or closed. This suction thus occurs directly in the reheater, before the vaporizable compounds reach the blowing shaft.

A preferred embodiment of the invention comprises connecting the top part of the vertically positioned suction duct to a flexible hose. The flexible hose adapts to the movements of the door in a particularly advantageous manner so that it is not necessary to provide for the arrangement of valves or bypasses in the pipe system.

According to a preferred embodiment of the invention, the top part of the door has connections with two levers that are parallel to each other and that in turn are each connected by a traction spring to an additional support. In this manner, the door can be moved easily. Opening and closing the door is facilitated because the arrangement of the traction springs results in a reduction of the force required to open the door, and the door can be closed gently. In addition, the traction springs assist the actions of the counter weight when the door is open in an advantageous manner so that the door is held open particularly reliably.

According to an additional advantageous embodiment of the invention, the door has in the bottom part a connection with at least one additional lever, preferably two levers. This additional moveable support of the door facilitates opening and closing of the door because the door is guided particularly reliably in its direction of movement.

According to another embodiment of the invention, the door has (instead of levers) at least at each comer of the rectangular shaped door a supporting roll, which is moved in guide rails, one on each side of the door. This constriction is particularly suited for sliding the door by pneumatical, electrical or hydraulic means.

According to an additional advantageous embodiment of the invention, the vertically positioned suction duct presents in the area of the transition to the nearly horizontally positioned suction duct a rectangular cross section of flow with a width s and a height t, which cross section decreases continuously in the direction of flow over the height of the door, and which undergoes a gradual transition in the top part of the vertically positioned suction duct to a circular cross section of flow with a diameter d. This facilitates connection of the vertically positioned suction duct to a shared collection line for removal of the vapors by suction.

In addition, the undesirable vaporizable compounds flow through a vertically positioned suction duct with a relatively large internal surface, resulting in cooling of the vapors that leads to the condensation of an appreciable portion of the vapors removed by suction in the vertically positioned Suction duct and not only to their separation in the pipe system connected downstream.

According to an additional embodiment of the invention, the exterior of the vertically positioned suction duct consists of a detachable first metal sheet that can be separated from the door to open the vertically positioned suction duct to the exterior. As a result, the vapors separated out in the vertically positioned suction duct can be removed rapidly and advantageously. The first metal sheet that can be separated from the door is here advantageously attached by screws.

According to an additional advantageous embodiment of the invention, the essentially horizontally positioned suction duct is delimited below by a detachable second metal sheet that is supported in a manner so it can be shifted vertically. Support here can be accomplished by bolt connections, which can be positioned in different length. The resulting advantage is that the height of the cross section of flow of the vertical Suction duct can be adjusted, in the transition to the essentially horizontally positioned suction duct, to the amount of undesirable vaporizable compounds. Furthermore, it is advantageous that, as a result, a homogenous suction output can be regulated over the entire width of the cross section of flow.

The invention is explained in greater detail below on the basis of an example given below with reference to the drawing (FIGS. 1–4).

FIG. 1 is a representation of a preferred embodiment of the door (1), the reheater (9) and the spinning head (12) in cross section. The door (1) is closed. The spinning package (10), which contains the spinning nozzle plate (not shown), is positioned in the spinning head (12). The door (1) for the reheater (9) of the spinning device consists of a heatable metal body (1*a*) an insulation (1*b*) positioned adjacently and externally to the metal body (1*a*), and a vertically positioned suction duct (1*c*) external to the insulation (1*b*) that opens at its bottom section into an essentially horizontally positioned suction duct (1*d*). The top part (1*e*) of the door (1) presents a connection with a lever (2), which lever is part of a lever system consisting of the lever (2), a support (3), and a counter weight (4). The lever (2) is also preferably connected through a traction spring (6) with an additional support (5). The top part (1*f*) of the vertically positioned suction duct (1*c*) is connected to a flexible hose (7). This flexible hose (7) compensates for the movements of the door (1). The vertically positioned suction duct (1*c*) is formed on the outside by a first metal sheet (1*g*), which can be separated from the duet. The essentially horizontally positioned suction duct (1*d*) is at a slope, with an angle of slope of less than 45°. In the bottom section of the door (1), handle (13) is positioned so that the door (1) can be opened or closed by it. The door (1) has, in the bottom section, a connection with an additional lever (8). The additional lever (8) assists in supporting, with rotation, of the door (1) by the lever (2). If the door (1) is to be opened, the opening is achieved using the handle (13) by lifting the door briefly away from the spinning device and moving it upwards. In this process, the counter weight (4) is lowered. In its uppermost position (when it is open), the door (1) is again applied directly to the spinning device so that the metal body (1*a*) is in thermal connection with the heated external wall of the spinning device, and thus strong cooling of the door (1) is advantageously prevented.

Figure 2:
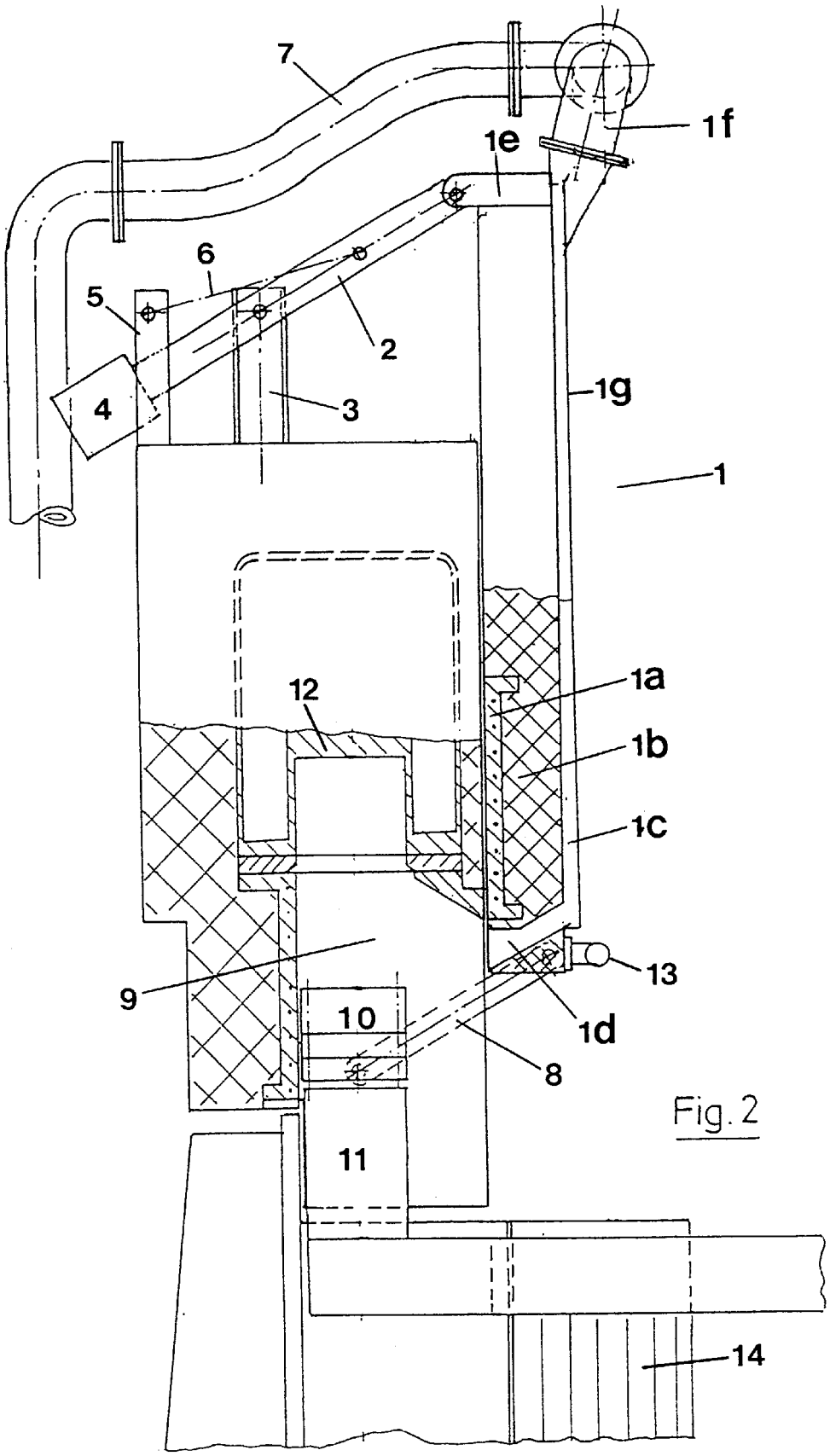
FIG. 2 shows the open door of a reheater, the reheater, and the spinning head in cross section.

FIG. 2 displays the open door (1) of the reheater (9) of the spinning device of FIG. 1 in cross section. The heatable metal body (1*a*), when the door is open (1), is applied to the spinning device, so that a cooling of the door (1) is largely prevented, and the reheater (9) is ready for operation immediately after closing the door (1). When the door is open (1), it is relatively easy to install the spinning package (10) in the spinning head (12). The spinning package (10) for this purpose is positioned on the mounting device (11) and is moved through the blowing shaft, whose doors (14) are open, and through the reheater (9) to the spinning head (12). While the door (1) is open, suction removal of the undesirable vaporizable compounds can occur through the essentially horizontally positioned suction duct (1*d*) now positioned directly below the spinning head (12).

Figure 3:
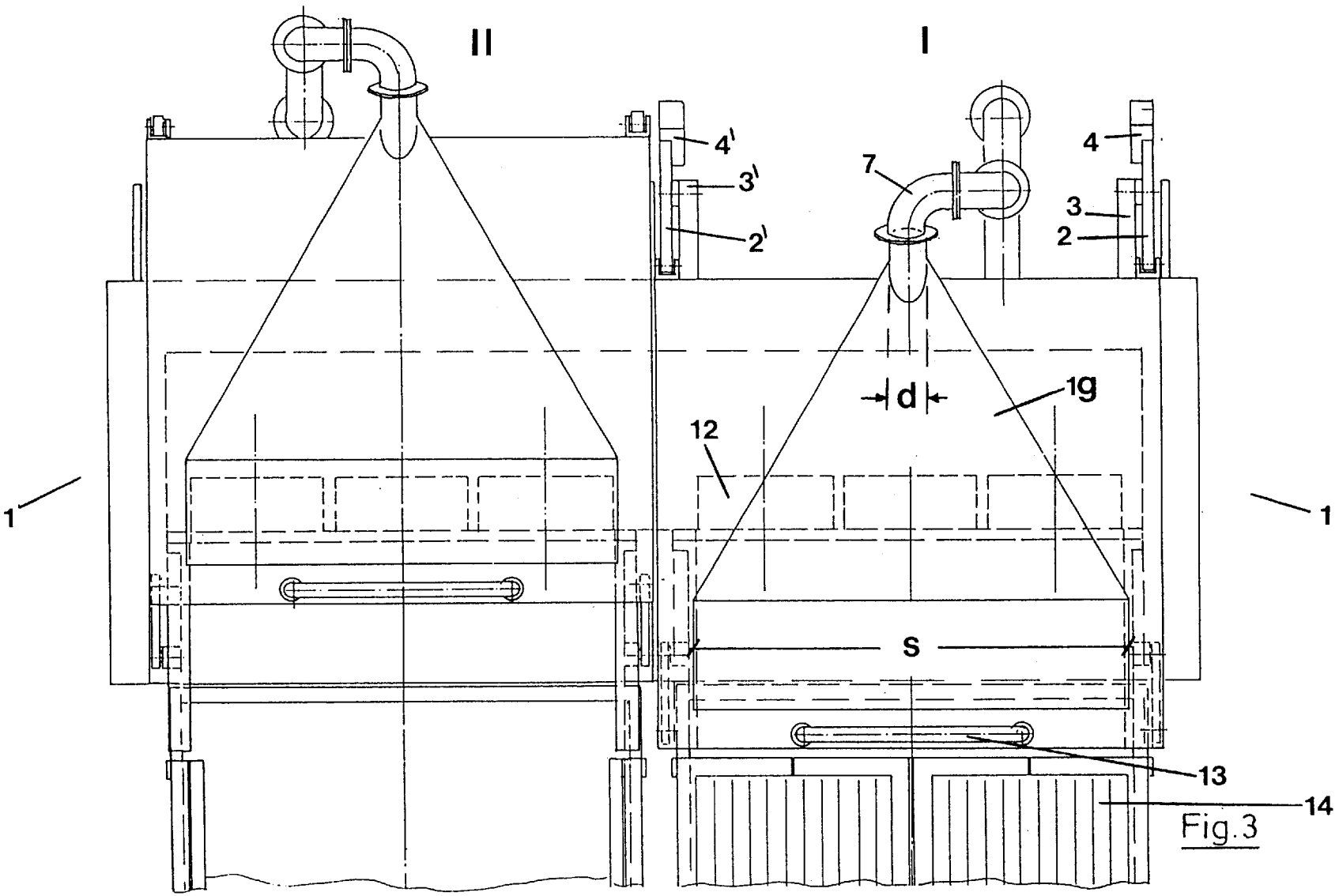
FIG. 3 shows two doors located next to each other, one open and the other closed.

FIG. 3 displays two arrangements (I, II) of two adjacent doors (1) according to FIGS. 1 and 2. The first arrangements (I) shows the door (1) closed. The second arrangements (II) shows the door (1) open. As represented in the first arrangements (I), the doors (1) have connections with two levers (2, 2'), which are parallel to each other and which are each a part of a lever system consisting of the lever (2, 2'), a support (3, 3') and a counter weight (4, 4'). In the bottom section of the door (1), the vertically positioned suction duct is formed by the first metal sheet (1*g*) that can be separated from the door, which duct has a width s. A rectangular cross section of flow is created that continuously decreases in size in the direction of flow over the height of the door (1), and which finally undergoes a transition to a circular cross section of flow with a diameter d.

Figure 4:
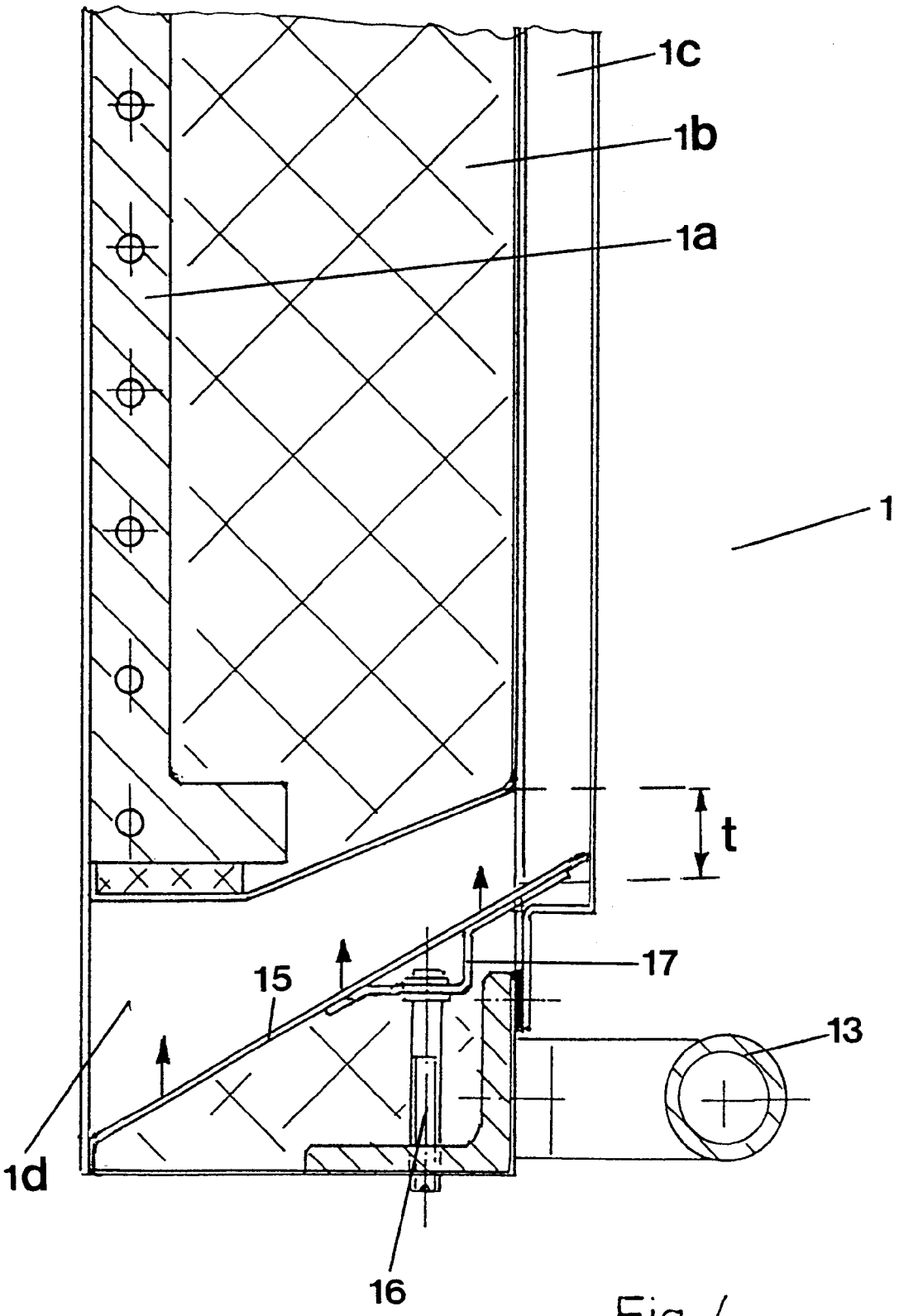
FIG. 4 shows the bottom section of the door of the reheater with the horizontally positioned suction duct in cross section.

FIG. 4 represents the bottom section of the door (1) in cross section. The essentially horizontally positioned suction duct (1*d*) is delimited below by a second metal sheet (15), which call be separated from the horizontally positioned suction duct (1*d*) and which is located in a support allowing a vertical shift in the direction of the arrow. The shifting and supporting here are achieved by a bolt connection (16), of which several can be positioned one after the other in the viewing direction (not shown). The bolt connection (16) is connected directly by means of a rectangular brace (17), which is attached to the bottom side of the second metal sheet (15). As a result of the support, which allows vertical shifting of the second metal sheet (15), the height t of the cross section of flow in the transition from the vertically positioned suction duct (1*c*) to the essentially horizontally positioned suction duct (1*d*) can be regulated, and thus suction removal of the undesirable vaporizable compounds can be optimized.

We claim:

1. A door for a spinning device reheater, the door comprising a heatable metal body, an insulation positioned externally adjacent to the metal body, and a vertically positioned suction duct externally adjacent to the insulation, said duct having a bottom section that opens into an essentially horizontally positioned suction duct, wherein the door is openable by sliding it vertically upwards.

2. The door according to claim 1, wherein the door further comprises a flexible hose, the vertically positioned suction duct having a top part that is connected to the flexible hose.

3. The door according to claim 1, wherein the vertically positioned suction duct has a rectangular cross section that gradually and continuously decreases in size in the direction from the bottom part to the top part of the door, and said cross section undergoes a transition in the top part of the vertically positioned suction duct from a rectangular to a circular cross section.

4. The door according to claim 1, wherein the vertically positioned suction duct is formed externally by a detachable first metal sheet, which is separable from the door.

5. The door according to claim 1, wherein the essentially horizontally positioned suction duct is delimited below by a detachable second metal sheet that is shiftable vertically.

6. The door according to claim 1, wherein the door further comprises a top part that is in connection with at least one lever, the lever being part of a lever system comprising said at least one lever, a support, and a counter weight.

7. The door according to claim 6, wherein the top part of the door is connected to two levers that are parallel to each other, and wherein each lever is in turn connected by a traction spring to an additional support.

8. The door according to claim 6, wherein the door further comprises a bottom part to which is connected at least one lever.

* * * * *